US006026572A

United States Patent [19]

Caldaro

[11] Patent Number: 6,026,572

[45] Date of Patent: Feb. 22, 2000

[54] MANUFACTURE OF A JEWELRY RING HAVING INNER LIPS AT EDGES THEREOF AND BEING ELONGATED AND SHAPED BY A ROLLER ASSEMBLY TO STRENGTHEN THE SAME

[75] Inventor: Vincent J. Caldaro, Neshanic Station, N.J.

[73] Assignee: Tapia Accessory Group, Inc., Kearny, N.J.

[21] Appl. No.: 09/079,553

[22] Filed: May 15, 1998

[51] Int. Cl.[7] ..... A44C 27/00

[52] U.S. Cl. ..... 29/896.412; 29/896.411; 72/105; 63/15

[58] Field of Search ..... 29/896.41, 896.411, 29/896.412; 72/91, 105, 106; 63/3, 15

[56] References Cited

U.S. PATENT DOCUMENTS

| | | | |
|---|---|---|---|
| 140,423 | 7/1873 | Krementz . | |
| 400,541 | 4/1889 | Bowden . | |
| 432,365 | 7/1890 | Bowden et al. . | |
| 433,578 | 8/1890 | Peckham . | |
| 472,959 | 4/1892 | Bernhardt . | |
| 473,139 | 4/1892 | Bernhardt . | |
| 512,676 | 1/1894 | Bernhardt . | |
| 533,182 | 1/1895 | Stafford . | |
| 764,862 | 7/1904 | Mossberg . | |
| 1,388,973 | 8/1921 | Schoellner et al. . | |
| 4,016,739 | 4/1977 | Lapin et al. | 72/105 |
| 4,510,781 | 4/1985 | Holt | 72/91 |

OTHER PUBLICATIONS

Brochure, All Form Tubing, Inc., Newark, New Jersey.

Brochure, "Machines and Tools for Gold and Silversmiths," FOV, Vicenza, Italy.

Brochure, "Calandra Tonda, " Macchine Ed Attrezzature Orafe, Arrezo, Italy.

*Primary Examiner*—P. W. Echols

*Attorney, Agent, or Firm*—Richard M. Goldberg

[57] ABSTRACT

A ring is formed by first inverting a washer comprising a substantially planar annular member with an outer circumference and a central opening defining an inner circumference, an inner lip extending from one side of the annular member at the inner circumference, an outer lip extending from the same side of the annular member at the outer circumference, and an intermediate section between the first and second lips that reduces in thickness from the inner lip to the outer lip, into a frusto-conical shape; then second inverting the frusto-conical shaped washer into a cylindrical element; and then cold working the cylindrical element by a cold rolling operation so that the annular member assumes an arcuate cross-sectional configuration of substantially constant thickness, whereby to increase a crushing strength of the ring due to the cold rolling and cold working of the cylindrical element and the lips.

7 Claims, 5 Drawing Sheets

MANUFACTURE OF A JEWELRY RING HAVING INNER LIPS AT EDGES THEREOF AND BEING ELONGATED AND SHAPED BY A ROLLER ASSEMBLY TO STRENGTHEN THE SAME

BACKGROUND OF THE INVENTION

The present invention relates generally to jewelry rings, and more particularly, is directed to jewelry rings having great strength and a method of making the same.

In making jewelry rings, such as wedding bands and the like, it is known to first invert a flat, annular washer in a first inversion forming machine, so as to form the washer into a frusto-conical or truncated cone shape. Thereafter, in a second inversion forming machine, the frusto-conical element is formed into a cylindrical element having a constant inner and outer diameter.

In order to present a rounded outer circumference to the cylindrical element, the outer surface can be shaved in a milling or other machine to provide the resultant ring. In such case, the inner surface has a flat, cylindrical shape, and is not rounded.

Alternatively, rounding machines are known for rolling rings in order to change the profile and/or size of rings. With these machines, an inner wheel is provided on which the cylindrical element or ring is mounted, with the inner wheel having a convex outer surface, and an outer wheel has a circumferential groove with a concave surface. Thus, when the inner wheel is rotated in one direction and the outer wheel is rotated in the opposite direction, a ring is formed with an arcuate inner and outer surface. This differs from the aforementioned shaved ring where the inner surface is flat, that is, with the latter arrangement, the inner and outer surfaces are both arcuate.

Although the rolling of the rings in a rounding machine increases the strength of such rings, the strength of such rings in a crush test is still not completely satisfactory.

It would therefore be desirable to substantially increase the strength of such rings, while providing a simple construction and a simple method of making the same.

SUMMARY OF THE INVENTION

It is an object of the present invention to provide a jewelry ring having substantially increased strength.

It is another object of the present invention to provide a jewelry ring having a simple construction.

It is still another object of the present invention to provide a jewelry ring in which two spaced circumferential lips are provided to substantially increase the strength thereof, and the ring is cold rolled in a rounding machine.

It is a further object of the present invention to provide a method of making a jewelry ring from a washer having two spaced circumferential lips by at least one inversion step and a cold rolling step.

It is a further object of the present invention to provide a method of making a jewelry ring in which the cold rolling step forms the inner and outer surfaces into complementary arcuate surfaces.

In accordance with an aspect of the present invention, a ring includes an annular member having a substantially constant thickness, the annular member having an arcuate transverse cross-sectional configuration and opposite annular edges. Each annular edge has an annular lip, and the annular member and the annular lips are formed from a cold worked material which has been cold worked after formation of the annular member with the lips, as a result of a cold rolling operation of the ring so as to increase a crushing strength of the ring.

In one embodiment, the annular member has an inner concave surface and an outer convex surface, and the annular lips are each formed on the inner concave surface at the annular edges and face inwardly of the ring. In another embodiment, the annular member has an outer concave surface and an inner convex surface, and the annular lips are each formed on the outer concave surface at the annular edges and face outwardly of the ring. In the latter embodiment, an outer annular band is positioned on the outer concave surface between the lips.

Preferably, the lips have a free end which is rounded, and the lips have a height equal to each other.

The cold worked material is preferably a metal material selected from the group consisting of gold, silver, platinum and basic alloys of bismuth, pewter, lead and tin.

In accordance with another aspect of the present invention, a washer for forming a ring by an inversion process, includes a substantially planar annular member having an outer circumference and a central opening defining an inner circumference, a first lip extending from one side of the annular member at the inner circumference, a second lip extending from the one side of the annular member at the outer circumference, and an intermediate section between the first and second lips.

The intermediate section has a thickness which reduces down from the inner lip toward the outer lip. Further, the inner lip extends to a height greater than a height of the outer lip, and the inner lip has a radial width greater than a radial width of the outer lip. Also, the lips each have a free, rounded end.

In accordance with still another aspect of the present invention, a method of making a ring, includes cold working an annular member having opposite annular edges, with an annular lip formed at each annular edge, by a cold rolling operation so that the annular member assumes an arcuate cross-sectional configuration of substantially constant thickness, whereby to increase a crushing strength of the ring.

The step of forming the annular member, includes the steps of first inverting a washer comprising a substantially planar annular member having an outer circumference and a central opening defining an inner circumference, a first lip extending from one side of the annular member at the inner circumference, a second lip extending from the one side of the annular member at the outer circumference, and an intermediate section between the first and second lips, into a frusto-conical shape; and then second inverting the frusto-conical shaped washer into a cylindrical element as the annular member.

The step of cold working includes the step of positioning the annular member about a first wheel having an arcuate surface, so that a portion of the annular member is pinched between the first wheel and a second wheel having an arcuate surface which is complementary to the arcuate surface of the first wheel; and rotating at least one of the first and second wheels so that the annular member is rotated therebetween and is cold rolled to have the arcuate cross-sectional configuration of substantially constant thickness.

In one embodiment, the first wheel has an outer convex surface and the second wheel has a complementary outer concave surface, so that the ring formed thereby has an inner concave surface and an outer convex surface, and the annular lips are each formed on the inner concave surface at the annular edges and face inwardly of the ring.

In another embodiment, the ring formed by the step of cold working has an inner convex surface and an outer concave surface, and the annular lips are each formed on the outer concave surface at the annular edges and face outwardly of the ring, and there is further the step of mounting an outer annular band on the outer concave surface between the lips.

The above and other objects, features and advantages of the present invention will become readily apparent from the following detailed description thereof which is to be read in connection with the accompanying drawings.

DETAILED DESCRIPTION

Figure 1:
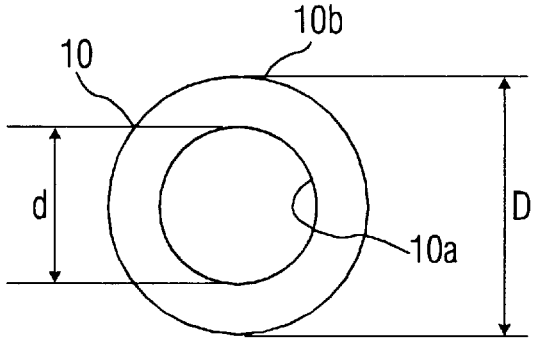
FIG. 1 PRIOR ART
FIG. 1 is a top plan view of a flat, annular washer used to form a jewelry ring according to the prior art.
Figure 2:
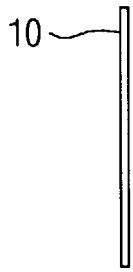
FIG. 2 PRIOR ART
FIG. 2 is an end elevational view of the washer of FIG. 1.

Referring first to FIGS. 1 and 2, there is shown a known flat, annular washer 10 used for making jewelry rings, such as wedding bands and the like. Washer 10 has a generally planar configuration with a central opening 10*a* which defines an inner circumference, an outer diameter D at outer circumference 10*b* and an inner diameter d at central opening 10*a*. Washer 10 is made of any suitable metal material such as gold, silver, platinum and basic alloys, such as bismuth, pewter, lead, tin, etc.

Figure 3:
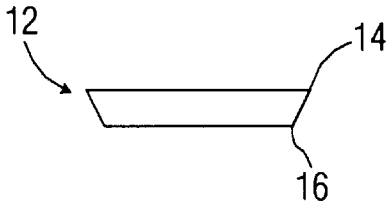
FIG. 3 PRIOR ART
FIG. 3 is a side elevational view of the washer of FIG. 1 after a first inversion step, according to the prior art, which is formed into a frusto-conical shape.
Figure 4:
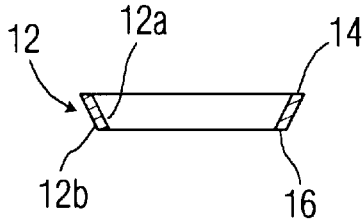
FIG. 4 PRIOR ART
FIG. 4 is a longitudinal cross-sectional view of the washer of FIG. 3.
Figure 5:
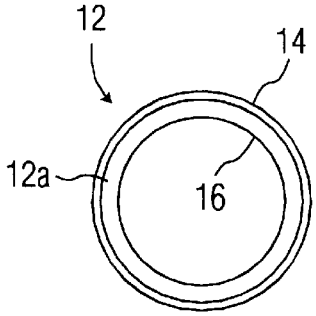
FIG. 5 PRIOR ART
FIG. 5 is a top plan view of the washer of FIG. 3.

As known, in a first inversion forming machine, washer 10 is cold worked so as to be deformed into a frusto-conical or truncated cone element 12 having a conical taper from a large diameter end 14 to a small diameter end 16, as shown in FIGS. 3–5. In such case, outer circumference 10*b* corresponds to large diameter end 14 and the inner circumference defined by central opening 10*a* corresponds to small diameter end 16. The angle of inclination of element 12 will vary depending upon the machine, but a generally 45° angle is common. It will be appreciated that inner surface 12*a* and outer surface 12*b* of element 12 are generally flat.

Figure 6:
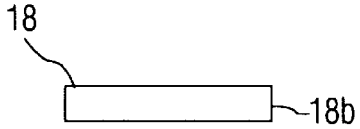
FIG. 6 PRIOR ART
FIG. 6 is a side elevational view of the washer of FIG. 3 after a second inversion step, according to the prior art, which is formed into a cylindrical ring with flat sides.
Figure 7:
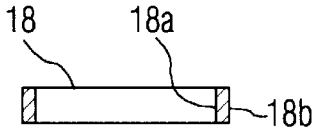
FIG. 7 PRIOR ART
FIG. 7 is a longitudinal cross-sectional view of the washer of FIG. 6.
Figure 8:
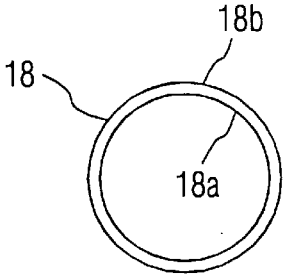
FIG. 8 PRIOR ART
FIG. 8 is a top plan view of the washer of FIG. 6.

Thereafter, in a second inversion forming machine, frusto-conical element 12 is formed into a cylindrical element 18 having a constant inner and outer diameter, as shown in FIGS. 6–8. It will be appreciated that inner surface 18*a* and outer surface 18*b* of cylindrical element 18 are generally flat, whereby element 12 has a constant thickness throughout.

Figure 9:
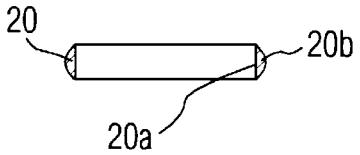
FIG. 9 PRIOR ART
FIG. 9 is a longitudinal cross-sectional view of the cylindrical ring of FIG. 6, with the outer surface shaved to provide an arcuate outer surface.

In order to present a rounded outer circumference to cylindrical element 18, outer surface 18*b* can be shaved in a milling or other machine to provide a curved outer surface 20*b* in a resultant ring 20, as shown in FIG. 9. In such case, inner surface 20*a* of ring 20 still is generally flat.

Figure 10:
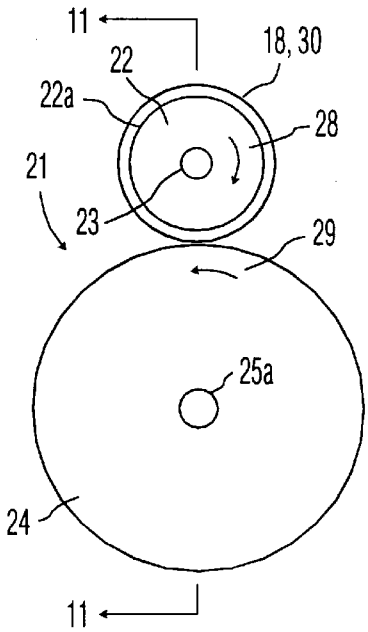
FIG. 10 PRIOR ART
FIG. 10 is an elevational view of a portion of a known rounding machine for rings in order to change the profile and/or size of the rings.
Figure 11:
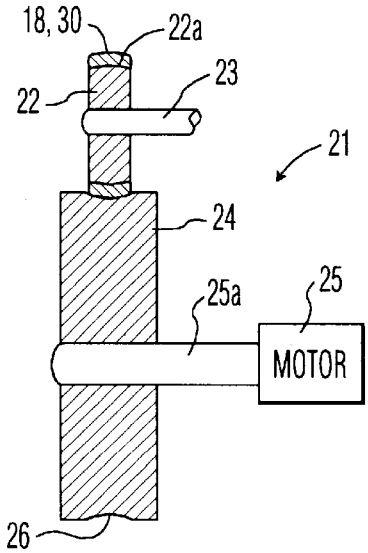
FIG. 11 PRIOR ART
FIG. 11 is a cross-sectional view of the rounding machine of FIG. 10.
Figure 12:
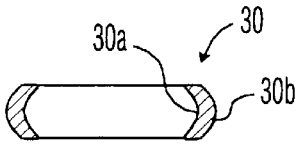
FIG. 12 PRIOR ART
FIG. 12 is a longitudinal cross-sectional view of the ring formed by the rounding machine of FIG. 10, in which both the inner and outer surfaces are arcuate.

Alternatively, rounding machines 21 for changing the profile and/or size of rings are known. Specifically, as shown in FIGS. 10 and 11, a rounding machine 21 includes an inner wheel 22 on which cylindrical element 18 is mounted, with inner wheel 22 having a convex or arcuate outer surface 22*a* with a greatest diameter equal to the inner diameter of cylindrical element 18. Inner wheel 22 is mounted on a shaft 23 which is rotatably mounted in a housing. Further, an outer wheel 24 is provided which has a circumferential groove 26 with a concave surface which is complementary to the convex outer surface 22*a* of inner wheel 22. Outer wheel 24 is mounted on a rotatable shaft 25*a* which either forms the output shaft of a motor 25 or is connected through gearing (not shown) to the motor output shaft. In addition, shaft 23 can be rotatably coupled with shaft 25*a* so that both are rotated in synchronism, but in opposite directions. Thus, when inner wheel 22 is rotated in the direction of arrow 28 and outer wheel 24 is rotated in the direction of arrow 29, a ring 30, which is pinched between wheels 22 and 24, is formed with an arcuate inner surface 30*a* and an arcuate outer surface 30*b*, as shown in FIG. 12. Ring 30 differs from ring 20 of FIG. 9 where inner surface 20*a* is flat, and there is no constant thickness. With ring 30 of FIG. 12, inner and outer surfaces 30*a* and 30*b* are both arcuate, and there is a constant thickness throughout ring 30.

Figure 13:
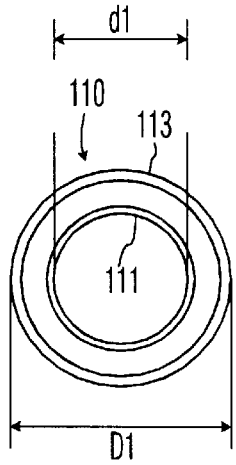
FIG. 13 is a top plan view of a flat, annular washer according to the present invention, for forming a ring.
Figure 14:
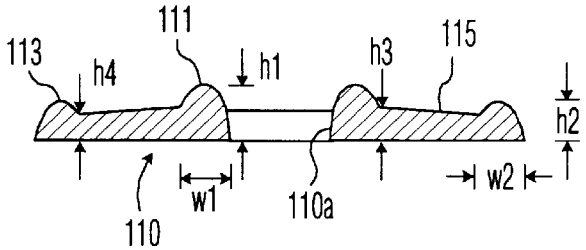
FIG. 14 is a longitudinal cross-sectional view of the washer of FIG. 13.

The present invention differs from the above. Specifically, as shown in FIGS. 13 and 14, the present invention starts with a flat, annular washer 110 which differs from washer 10 of FIGS. 1 and 2 by providing a rounded inner rim or lip 111 and a rounded outer rim or lip 113, both on the same side of washer 110 and facing in the axial direction of washer 110. Washer 110 has a generally planar configuration with a central opening 110*a,* and with an outer diameter D1 at outer circumference 110*b* and an inner diameter d1 at the inner circumference defined by central opening 110*a.* Washer element 110 is preferably made of any suitable metal material such as gold, silver, platinum and basic alloys, such as bismuth, pewter, lead, tin, etc.

Inner lip 111 preferably has a greater height than outer lip 113 in order for lips 111 and 113 in the final product to have the same height, due to the stretching of the material of washer 110 in the inversion steps. It is further noted that the upper surface of intermediate section 115 between lips 111 and 113 is inclined, which again is necessary due to the inversion process. For example, for a 6 mm, size 10 ring to be formed with an overall thickness of 0.015 inch in intermediate section 115 and a thickness or height of 0.032 inch in each of inner and outer lips 111 and 113, the following dimensions of washer 110 can be used:

a: outer diameter D1=1.018 inch;

b: inner diameter d1=0.495 inch;

c: height h1 of inner lips 111=0.038 inch;

d: radial width w1 of inner lips 111=0.052 inch;

e: height h2 of outer lips 113=0.025 inch;

f: radial width w2 of outer lips 113=0.034 inch;

g: height h3 of intermediate section 115 immediately adjacent inner lips 111=0.023 inch;

h: height h4 of intermediate section 115 immediately adjacent outer lips 113=0.017 inch.

Figure 15:
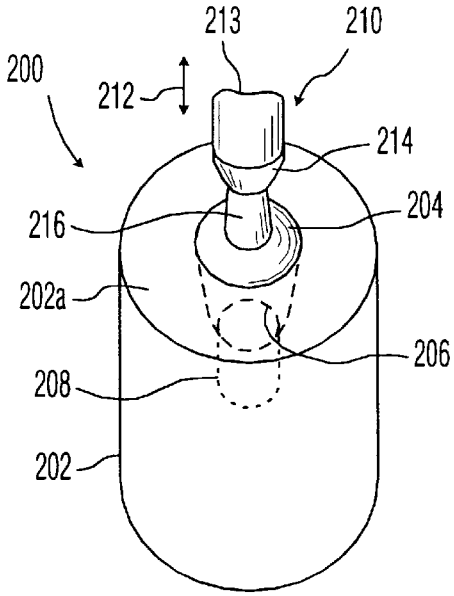
FIG. 15 is a perspective view of a first inversion forming machine for forming a washer into a frusto-conical shape.
Figure 16:
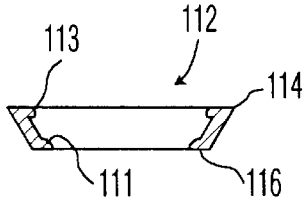
FIG. 16 is a longitudinal cross-sectional view of the frusto-conical element formed by the first inversion forming machine of FIG. 15.

Then, in a first inversion forming machine 200 shown in FIG. 15, washer 110 is formed into a frusto-conical or truncated cone element 112 having a conical taper from a large diameter end 114 to a small diameter end 116, and with lips 111 and 113 facing inwardly, as shown in FIG. 16. First inversion forming machine 200 includes a cylindrical base 202 having a frusto-conical or truncated cone shaped opening 204 at an upper surface 202*a* thereof, with opening 204 terminating at its lower end 206 into a cylindrical opening 208 having a diameter equal to the lower, lesser diameter of frusto-conical opening 204.

A forming tool 210 is movable in the direction of arrow 212, and includes an upper cylindrical support 213 of a first diameter, connected at its lower end with a frusto-conical or truncated cone shaped portion 214, which then terminates in a cylindrical portion 216 of a second lesser diameter. The inclination of frusto-conical portion 214 is the same as the inclination of frusto-conical opening 204, but of a lesser diameter, so as to accommodate washer 110 therebetween. In such case, when washer 110 is initially positioned on tool 210, it seats on frusto-conical portion 214 since the inner diameter d1 of washer 110 is of a size between the greatest and least diameters of frusto-conical portion 214.

When tool 210 moves down in the direction of arrow 212, cylindrical portion 216 passes through central opening 110*a* in washer 110 and forces washer 110 between the truncated cone shaped portion 214 and truncated cone shaped opening 204 in order to form the same into frusto-conical or truncated cone element 112. Then, forming tool 210 is raised so as to remove frusto-conical element 112.

Figure 17:
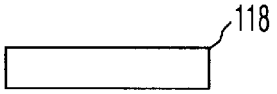
FIG. 17 is a perspective view of a first inversion forming machine for forming a washer into a cylindrical shape having flat inner and outer surfaces.
Figure 18:
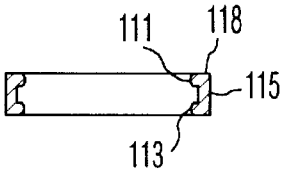
FIG. 18 is a longitudinal cross-sectional view of the cylindrical element formed by the second inversion forming machine of FIG. 17.
Figure 19:
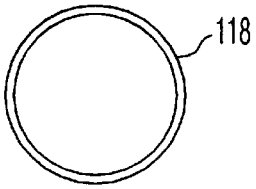
FIG. 19 is a top plan view of the cylindrical element of FIG. 18.
Figure 20:
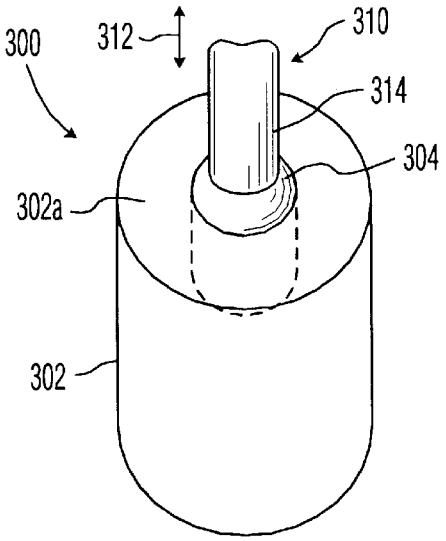
FIG. 20 is a perspective view of a second inversion forming machine for forming a washer into a cylindrical shape.

Thereafter, in a second inversion forming machine 300 which is shown in FIG. 20, truncated cone element 112 of FIG. 16 is formed into a flat, cylindrical element 118 having a constant inner and outer diameter, and with a constant thickness, as shown in FIGS. 17–19. Second inversion forming machine 300 includes a cylindrical base 302 having a cylindrical shaped opening 304 at an upper surface 302*a* thereof.

A forming tool 310 is movable in the direction of arrow 312, and includes a cylindrical portion 314 of a lesser diameter than cylindrical shaped opening 304, so as to accommodate truncated cone element 112 thereon. In such case, truncated cone element 112 has an inner diameter less than the outer diameter of cylindrical portion 314 so as to seat thereon.

When tool 310 moves down in the direction of arrow 312, cylindrical portion 314 passes through the central opening in truncated cone element 112 and forces truncated cone element 112 between cylindrical portion 314 and cylindrical shaped opening 304 in order to form the same into cylindrical element 118. Then, forming tool 310 is raised so as to remove cylindrical element 118.

In such case, annular lips 111 and 113 are provided at opposite inner edges of cylindrical element 118. It will be appreciated that, because of the first and second inversion steps, the thickness of intermediate section 115 of cylindrical element 118 becomes constant, for example, equal to a thickness of 0.015 inch in the aforementioned example.

Figure 21:
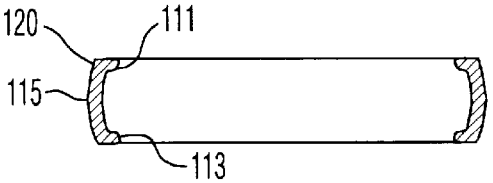
FIG. 21 is a longitudinal cross-sectional view of a ring according to the present invention, formed after being cold rolled by rolling with the rounding machine of FIG. 10.

In order to present a rounded outer circumference to cylindrical element 118, as shown by ring 120 in the cross-sectional view of FIG. 21, rounding machine 21 of FIGS. 10 and 11 is used. It has been discovered by the present inventor that this cold working or cold rolling of the metal, which causes an elongation of the metal, in combination with lips 111 and 113, results in a great increase in strength of ring 120 against bending or crushing of the same. When using rounding machine 21, intermediate section 115 is placed on inner roller 28 and formed into the arcuate section of FIG. 21. At the same time, lips 111 and 113 are cold rolled and deformed by the deformation of intermediate section 115.

Specifically, in tests that were performed, all rings were formed from washers 10 or 110 of the same size, to form a 10 carat, 6 mm, size 10 gold ring with an outside diameter of 0.870 inch, and having an identical density.

Ring 1

A first ring 18 (FIGS. 6–8) was formed from washer 10 (FIGS. 1 and 2) using first inversion machine 200 and second inversion machine 300. In such case, washer 10 had no lips 111 and 113. Ring 18 that was formed had flat inner and outer annular surfaces, as shown in FIGS. 6–8.

Ring 2

A second ring 118 (FIGS. 17–19) was formed from washer 110 (FIGS. 13 and 14) using first inversion machine 200 and second inversion machine 300. In such case, washer 110 had lips 111 and 113. Ring 118 that was formed had flat inner and outer cylindrical surfaces, as shown in FIGS. 17–19.

Ring 3

A third ring 30 (FIG. 12) was formed from washer 10 (FIGS. 1 and 2) using first inversion machine 200 and second inversion machine 300. In such case, washer 10 had no lips 111 and 113. Ring 30 that was formed was cold rolled on rounding machine 21 of FIGS. 10 and 11, and had rounded inner and outer annular surfaces, as shown in FIG. 12.

Ring 4

A fourth ring 120 (FIG. 21) according to the present invention was formed from washer 110 (FIGS. 13 and 14)

using first inversion machine 200 and second inversion machine 300. In such case, washer 110 had lips 111 and 113. Ring 120 that was formed was cold rolled on rounding machine 21 of FIGS. 10 and 11, and had rounded inner and outer annular surfaces, as shown in FIG. 21.

After Rings 1–4 were formed, they were each placed in a test apparatus. Specifically, the rings were held upright by a parallel clamp, holding the edge only. Weights were placed gently on each ring until the ring collapsed to a height of 0.8 inch, resulting in an oval shape. The weights that were necessary to so deform each ring were as follows:

| RING | WEIGHT TO DEFORM (pounds) |
|---|---|
| 1 | 14 |
| 2 | 15 |
| 3 | 22 |
| 4 | 28 |

It is seen from the above that the addition of lips 111 and 113 to Ring 2 only added minimal strength over that of flat Ring 1 with no lips.

Further, the use of a rounding machine to cold deform Ring 3 added much strength to rounded Ring 3 with no lips over flat Ring 1 with no lips. However, the addition of lips 111 and 113 to Ring 4 in addition to the rounding process, resulted in much greater strength of rounded Ring 4 with lips according to the present invention over rounded Ring 3 with no lips. The difference in strength between Rings 3 and 4 was much greater than the difference in strength between Rings 2 and 1.

Therefore, the cold rolling or deformation of Ring 4, along with the consequent cold deformation of lips 111 and 113 substantially increased the strength of Ring 4 over any of the other rings.

Although the use of a rounding machine as shown in FIGS. 10 and 11 is known, the present invention therefore lies in the combination of the inner and outer lips 111 and 113, along with the rounding process. As a result of this process, the strength of the ring is increased over rings which merely use a rounding machine.

It will be appreciated that the present invention can be modified within the scope of the invention. For example, rather than forming the ring into the shape of cylindrical element 118 of FIGS. 17–19 prior to using rounding machine 21, the ring can be formed into the arcuate shape of ring 120 of FIG. 21 by any means, such as casting or the like, and then used in rounding machine 21 to increase the size of ring 120. In such case, the use of lips 111 and 113 and the cold rolling to increase the size of the ring would substantially increase the strength of the ring, since there would still be cold working of lips 111 and 113.

However, if ring 120 of FIG. 21 is merely formed in a casting process, it will not have the same strength. This is because there has been no elongation or cold working of the metal, which substantially increases the strength thereof.

Therefore, either the ring 118 of FIGS. 17–19 or the ring 120 of FIG. 21 can be formed by a casting or other process, and then subjected to elongation and/or deformation by rounding machine 21 of FIGS. 10 and 11. This rounding operation, which results in elongation of the metal material, in conjunction with inner and outer lips 111 and 113, results in substantial increases in strength of the finally formed ring.

As an alternative, ring 118 or ring 120 can be formed from a flat, elongated, stamped material having lips, which has its opposite ends welded together into an annular shape, and which is then rolled to cold work the same.

Of course, the ring can then be finished or buffed to provide a smooth and shiny appearance. Alternatively, the finished ring can be subjected to an embossing or other cutting operation to provide a cut design on the outer surface of the finished ring.

Figure 22:
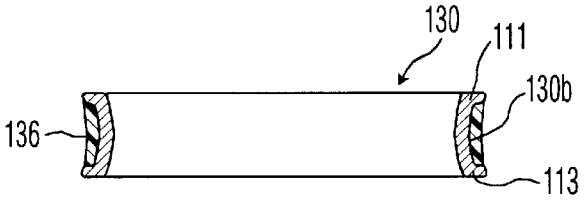
FIG. 22 is a longitudinal cross-sectional view of a ring according to another embodiment of the present invention, formed after being cold rolled by a rounding machine.

As a further alternative, as shown in FIG. 22, a ring 130 can be formed which is inverted from ring 120 shown in FIG. 21, that is, in which the outer surface 130*b* of ring 130 has a concave shape, rather than a convex shape, and with lips 111 and 113 extending radially outward from outer surface 130*b*. Ring 130 would be formed in the same manner as ring 120, except that lips 111 and 113 would be positioned to the outside, rather than the inside, and the outer surface of inner roller 22 of rolling machine 21 would be concave, while the outer surface of outer roller 24 would be convex.

In such case, a metal or plastic band 136 can be positioned on concave outer surface 130*b* between circumferential lips 111 and 113. However, as with ring 120, because of lips 111 and 113, and the elongation or cold working thereof to form concave surface 130*b* by a rounding machine, the same structural rigidity is provided.

Although the present invention is disclosed with respect to metal rings made from, for example, gold, silver, platinum and basic alloys, such as bismuth, pewter, lead, tin, etc., the ring can be made as described above out of any other suitable material, such as plastic, crushed or pulverized stones (gems) that are adhered together, etc.

Also, although the present invention is described relative to rings, it can also be used for other items, such as bracelets, earrings, etc.

Figure 12A:
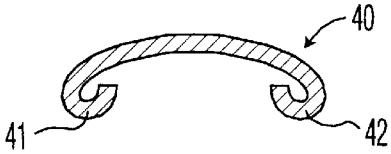
FIG. 12A PRIOR ART
FIG. 12A is a longitudinal cross-sectional view of a bracelet formed according to the prior art with bent over ends.

It will be appreciated, as shown in the cross-sectional view of FIG. 12A, that it is known to provide opposite ends of a bracelet, ring or the like 40 bent under to present the appearance of opposite lips 41 and 42. However, this is very different and does not provide the structural rigidity of the present invention.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A method of making a ring, comprising cold working an annular member having opposite annular edges, with an annular lip formed at each annular edge, by a cold rolling operation so that said annular member assumes an arcuate cross-sectional configuration of substantially constant thickness between the lips, whereby to increase a crushing strength of said ring.

2. A method according to claim 1, further comprising the step of forming said annular member, including the steps of:

first inverting a washer comprising a substantially planar annular member having an outer circumference and a central opening defining an inner circumference, a first lip extending from one side of said annular member at said inner circumference, a second lip extending from said one side of said annular member at said outer circumference, and an intermediate section between said first and second lips, into a frusto-conical shape; and second inverting said frusto-conical shaped washer into a cylindrical element as said annular member.

3. A method according to claim 2, wherein said intermediate section of said washer has a thickness which reduces down from said inner lip toward said outer lip, and said inner lip has a height greater than a height of said outer lip.

4. A method according to claim 2, wherein said washer is made from a material selected from the group consisting of gold, silver, platinum and basic alloys of bismuth, pewter, lead and tin.

5. A method according to claim 1, where said step of cold working includes the steps of:

positioning said annular member about a first wheel having an arcuate surface, so that a portion of said annular member is pinched between said first wheel and a second wheel having an arcuate surface which is complementary to the arcuate surface of the first wheel; and rotating at least one of said first and second wheels so that said annular member is rotated therebetween and is cold rolled to have said arcuate cross-sectional configuration of substantially constant thickness.

6. A method according to claim 5, wherein said first wheel has an outer convex surface and said second wheel has a complementary outer concave surface, so that the ring formed thereby has an inner concave surface and an outer convex surface, and said annular lips are each formed on said inner concave surface at said annular edges and face inwardly of said ring.

7. A method according to claim 5, wherein said ring formed by said step of cold working has an inner convex surface and an outer concave surface, and said annular lips are each formed on said outer concave surface at said annular edges and face outwardly of said ring, and further comprising the step of mounting an outer annular band on said outer concave surface between said lips.

* * * * *